US006152088A

United States Patent [19]

Occella et al.

[11] Patent Number: 6,152,088

[45] Date of Patent: Nov. 28, 2000

[54] COOLING SYSTEM FOR A MOTOR-VEHICLE INTERNAL COMBUSTION ENGINE

[75] Inventors: Sergio Occella; Vladimiro Patrone; Dante Rodolfo Malatto, all of Orbassano, Italy

[73] Assignee: C.R.F. Societa Consortile per Azioni, Orbassano, Italy

[21] Appl. No.: 09/123,469

[22] Filed: Jul. 28, 1998

[30] Foreign Application Priority Data

Aug. 1, 1997 [IT] Italy ..... TO97A0698

[51] Int. Cl.[7] ..... F01P 7/14

[52] U.S. Cl. ..... 123/41.1; 123/41.01

[58] Field of Search ..... 123/41.01, 41.29, 123/41.1

[56] References Cited

U.S. PATENT DOCUMENTS

| | | | |
|---|---|---|---|
| 4,352,342 | 10/1982 | Cser et al. | 123/41.54 |
| 4,369,738 | 1/1983 | Hirayama | 123/41.1 |
| 4,381,736 | 5/1983 | Hirayama | 123/41.1 |
| 4,423,705 | 1/1984 | Morita et al. | 123/41.02 |
| 4,539,942 | 9/1985 | Kobayashi et al. | 123/41.1 |
| 5,386,805 | 2/1995 | Abe et al. | 123/41.28 |

*Primary Examiner*—Willis R. Wolfe
*Assistant Examiner*—Jason Benton
*Attorney, Agent, or Firm*—Sughrue, Mion, Zinn, Macpeak & Seas, PLLC

[57] ABSTRACT

A cooling system for an internal combustion engine of a motor-vehicle has two separate cooling circuits for the cylinder head and the engine block. The cooling fluid which flows through the cylinder head circulates through a radiator in all operating conditions of the cooling system. The cooling fluid which flows through the engine block is instead de-routed so that it does not flow through the radiator and, when it comes out of the engine block, is fed into a conduit at the outlet from the head so that the engine block is kept at a temperature greater than that of the head. An electronic control unit controls the adjustment of a pump for activating the circulation of the cooling fluid, and a flow control valve which de-routes a portion of the cooling fluid at the outlet of the pump towards the engine block. The electronic control unit carries out the above regulations as a function of signals directed thereto from a plurality of sensors which are indicative of a number of engine operating parameters.

5 Claims, 1 Drawing Sheet

COOLING SYSTEM FOR A MOTOR-VEHICLE INTERNAL COMBUSTION ENGINE

BACKGROUND OF THE INVENTION

The present invention relates to cooling systems for motor-vehicle internal combustion engines.

In recent times, car manufacturers have posed an increasing attention in order to obtain an optimal distribution of the temperatures of the engine so as to provide a reduction of the fuel consumption and noxious emissions in the exhaust gases.

More in detail, it is necessary to distinguish the following main problems: the reduction in time for warm-up of the engine after that it has been started at cool temperature; the need of keeping the temperatures on the walls of the combustion chamber and above all on the cylinder walls as higher as possible during this warm-up period; and the need of controlling the engine temperature during normal operation.

There is further the need, above all at partial loads, of keeping the temperature of the engine block relatively high, in order to increase the fluidity of the lubricating oil and decreasing the friction losses, whereas it is necessary to keep the temperature of the engine cylinder head relatively low, in order to avoid detonation at full load. In other words, there is an interest to differentiate the average temperature of the engine block and that of the cylinder head in order to decrease the mechanical losses on one hand and to avoid the risk of detonation on the other hand. Even if at partial loads the engine could stand temperatures of the head comparable with those of the engine block, this condition is anyhow to be avoided since it is not possible nor advisable to cool the engine head during the relatively short time interval which is necessary for coming to a high operating load of the engine. Therefore, the temperature of the cylinder head must be kept substantially constant at any running condition of the engine, while the possibility of varying that of the engine block must be provided.

SUMMARY OF THE INVENTION

In order to achieve these results, the present invention provides a cooling system for a motor-vehicle internal combustion engine, comprising an engine block and a cylinder head, said system including:

- a first cooling circuit for the cylinder head, and a second cooling circuit for the engine block, separated from each other, each having an inlet and an outlet,
- a radiator,
- first conduit means for feeding a cooling fluid coming out of the first head cooling circuit to the radiator and from the latter back to the inlet of the first head cooling circuit,
- a pump interposed in said conduit means, for circulating the cooling fluid,
- second conduit means for feeding a portion of the cooling fluid coming out of the pump towards the inlet of the second cooling circuit for the engine block, the outlet of said second circuit being connected to said conduit means downstream of the outlet of said first cooling circuit.

Preferably, the aforementioned pump is adapted to be de-activated during the engine operation, and there are provided means for controlling activation and deactivation of the pump.

Also preferably, the system further comprises a flow regulating valve interposed in said conduit means, downstream of the pump, between said pump and the radiator, for feeding a part of the cooling fluid towards the inlet of the second cooling circuit for the engine block, said control means being adapted to control also said flow regulating valve.

In a preferred embodiment, said pump is variable speed electric pump and said control means are electronic means adapted to receive signals from a plurality of sensors indicative of many engine operating parameters.

Preferably, said sensor means comprises one or more of the following sensors: a sensor for the rotational speed of the engine, a sensor for the engine load, a sensor for the ambient temperature, a sensor of the temperature of the metal body of the engine and the temperature of the fluid in the first cooling circuit, the temperature in the second cooling circuit and the temperature at the outlet of the first cooling circuit.

Due to these features, the cooling system according to the invention is able to keep the cylinder head and the engine block at two different temperatures. The cooling fluid coming from the radiator is fed directly to the cylinder engine where it takes heat while increasing in temperature. At the outlet of the cylinder engine the fluid is mixed with the cooling fluid coming from the engine block and then it goes through the pump and of the flow regulating valve which attends to directing a part of the cooling fluid to the engine block. The cooling fluid directed to the cylinder head has preferably a temperature in the order to 70–80° C. and goes out at a temperature in the order of 90° C. A part of the cooling fluid at this temperature is fed to the engine block, increasing locally its temperature up to the maximum accepted levels, in the order of 120° C. At the outlet of the engine block, the cooling fluid is mixed with the fluid coming from the cylinder head which causes a decrease of the temperature thereof. The pump and the flow regulating valve are controlled by an electronic control unit on the basis of the signals sent by said sensor means, so as to provide optimal cooling features at every condition of operation of the engine.

During warm-up of the engine after that it has been started at cool temperature, the circulation of the cooling fluid can be started firstly within the cylinder head only (to avoid detonation and stresses in the structure), the fluid being still or having a very limited circulation within the engine block.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
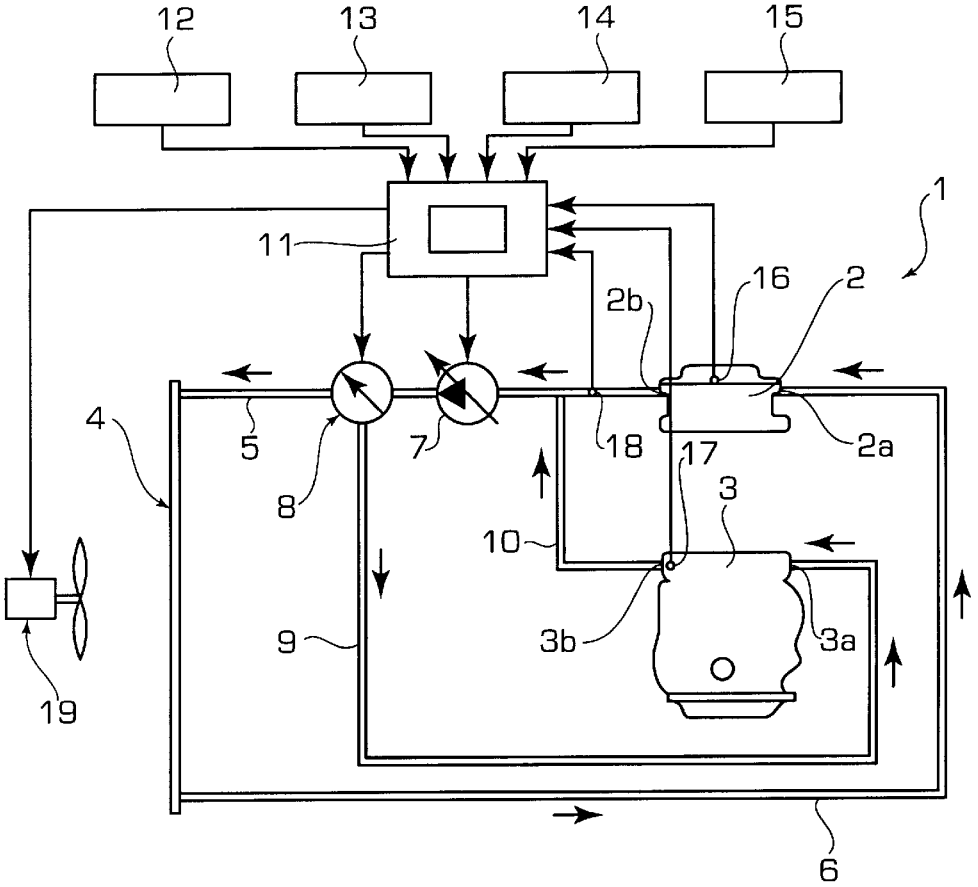
FIG. 1 is a diagram of a preferred embodiment of a cooling system according to the invention.

In the drawings, reference numeral 1 generally designates a cooling system for a motor-vehicle internal combustion engine, comprising a cylinder head and an engine block. In the drawings, the blocks designated by 2 and 3 designate the cooling systems of the cylinder head and the engine block respectively, which are separated from each other. The cooling circuit 2 of the head has an inlet 2*a* and an outlet 2*b*, whereas the cooling circuit 3 of the engine block has an inlet 3*a* and an outlet 3*b*. The cooling system comprises, according to the conventional technique, a radiator 4 of any known type which is fed by a conduit 5 with a cooling fluid coming from the pump 7. The cooling fluid which goes through the radiator 4 is fed back to the inlet 2*a* of the cooling circuit 2 of the engine head by a return conduit 6. In conduit 5 there is interposed a pump 7, preferably of the variable speed type (such as an electric pump) of any known type serving for activating the fluid circulation. In conduit 5, downstream of pump 7, there is further interposed a flow regulating valve 8, preferably electrically controlled, such as a proportional solenoid valve or an on/off type solenoid valve (even if the use of any other equivalent device, such as a mechanical or hydraulic or pneumatic device, is not excluded), adapted to de-route a part of the flow coming from the outlet of pump 7 into a conduit 9. Conduit 9 is connected to the inlet 3*a* of the cooling circuit 3 of the engine block, the fluid coming out of this circuit merging back into conduit 5 upstream of pump 7, through a conduit 10.

In operation, the cooling fluid which flows through the cooling circuit 2 of the cylinder head always goes through the radiator 4, flowing through a conduit 5 on its way to the radiator and through conduit 6 on the way back. The cooling circuit 3 for the engine block receives instead the portion of flow which is de-routed by valve 8 and is not cooled in radiator 4, so as to keep the temperature of the engine block 3 at a higher level than the temperature of the head 2. In this way, the film of lubricating oil on the walls of the cylinders in the engine block can be kept in a greater fluid state, so as to decrease the friction losses, whereas the head is always kept at a temperature which assures the absence of detonation.

Furthermore, the pump 7 and valve 8 are controlled by an electronic control unit 11 on the basis of signals coming from a sensor 12 of the rotational speed of the engine, a sensor 13 of the engine load, a sensor 14 of the ambient temperature, a sensor 15 of the motor-vehicle speed, and temperature sensors 16, 17, 18 arranged in the head cooling circuit 2, in the engine block cooling circuit 3, and at the outlet of the head cooling circuit. The electronic control unit 11 preferably provides for the control of the operation of an electric fan 19 associated with radiator 4 according to a conventional technique.

Figure 2:
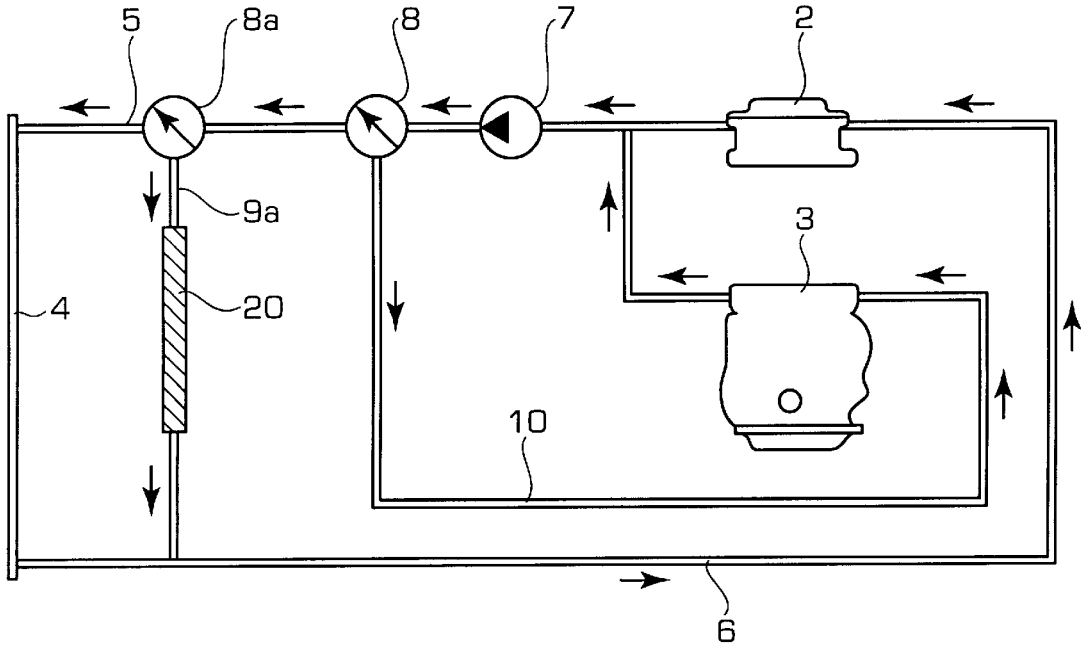
FIG. 2 shows a variant of FIG. 1.

FIG. 2 of the annexed drawings shows a variant of FIG. 1 which differs from the latter only in that it has a second regulating valve 8*a* for de-routing a portion of the total flow of the cooling fluid into a conduit 9*a* which goes through an air heater for the motor-vehicle passenger compartment, designated by 20.

From the foregoing description, it is clearly apparent that the cooling system according to the invention keeps the engine head and block at different temperatures (the difference of these temperatures depending from the temperature decrease provided by radiator 4), so as to reduce the friction losses on one hand and avoid the risk of detonation on the other hand.

More temperature sensors (such as thermocouples) are preferably provided at different areas of the head in order to be able to distinguish hotter areas (to decrease noxious emissions at the exhaust) and colder areas (to avoid detonation).

Naturally, while the principle of the invention remains the same, the details of construction and the embodiments may widely vary with respect to what has been described and illustrated purely by way of example, without departing from the scope of the present invention.

What is claimed is:

1. Cooling system for a motor-vehicle internal combustion engine, comprising an engine block and a cylinder head, said system including:

a first cooling circuit for the cylinder head, and a second cooling circuit for the engine block, which are separated from each other, each circuit having an inlet and an outlet, a radiator, first conduit means for feeding a cooling fluid coming out of the outlet of said first cooling circuit for the cylinder head to the radiator and from the radiator back to the inlet of the first cooling circuit for the head, a variable speed pump driven by an electric motor, said pump being interposed in said first conduit means for activating the circulation of the cooling fluid, and second conduit means for feeding a portion of the cooling fluid coming out of the pump towards the inlet of the second cooling circuit for the engine block, the outlet of said second circuit being connected to said first conduit means downstream of the outlet of said first cooling circuit, wherein said control means are electronic control means adapted to receive signals from a plurality of sensors indicative of more parameters of operation of the engine, and wherein said sensor means comprises one or more of the following sensors: a sensor of the rotational speed of the engine, a sensor of the engine load, a sensor of the ambient temperature, a sensor of the vehicle speed, and sensors of the temperature of the metal body of the engine and the fluid in the first cooling circuit, in the second cooling circuit and at the outlet of the first cooling circuit.

2. System according to claim 1, wherein said pump is adapted to be de-activated during operation of the engine, and means are provided for controlling activation and de-activation of the pump.

3. System according to claim 1, wherein it further comprises a flow regulating valve interposed in said conduit means, downstream of the pump, between first pump and the radiator, for feeding a portion of the cooling fluid towards the inlet (3*a*) of the second cooling circuit of the engine block, said control means being adapted to controlling also said flow regulating valve.

4. System according to claim 3, wherein there are provided local temperature sensors at different areas of the head and the block.

5. System according to claim 3, wherein it includes a second flow regulating valve arranged downstream of said flow regulating valve for de-routing a portion of the cooling fluid towards an air heater for the motor-vehicle passenger compartment, whose outlet is connected to a conduit for returning the fluid coming out of the radiator into the inlet of the first cooling circuit for the cylinder head.

* * * * *